US005602504A

United States Patent [19]

Liu

[11] Patent Number: 5,602,504

[45] Date of Patent: Feb. 11, 1997

[54] FOUR-QUADRANT THREE-INPUT MULTIPLIER

[75] Inventor: Shen-Iuan Liu, Keelung, Taiwan

[73] Assignee: National Science Council, Taiwan

[21] Appl. No.: 528,558

[22] Filed: Sep. 15, 1995

[51] Int. Cl.[6] ..... G06G 7/16

[52] U.S. Cl. ..... 327/357; 327/100; 327/355; 327/359; 327/113; 327/119; 327/361; 455/326; 455/333

[58] Field of Search ..... 327/113, 119, 327/116, 103, 105, 355, 356, 357, 359, 100, 361; 455/326, 333, 323, 330

[56] References Cited

U.S. PATENT DOCUMENTS

| | | | |
|---|---|---|---|
| 4,405,829 | 9/1983 | Rivest et al. | 178/22.1 |
| 4,586,155 | 4/1986 | Gilbert | 327/357 |
| 5,151,624 | 9/1992 | Stegherr et al. | 327/356 |

OTHER PUBLICATIONS

"Modular Multiplication Without Trial Division" by P. L. Montgomery plublished in the journal Mathematics of Computation, vol. 44, No. 170 Apr. 1985, pp. 519 to 521.

*Primary Examiner*—Timothy P. Callahan
*Assistant Examiner*—Dinh T. Le
*Attorney, Agent, or Firm*—Spencer & Frank

[57] ABSTRACT

A four-quadrant three-input multiplier is disclosed. The three-input multiplier, which finds the product of a first input signal, a second input signal, and a third input signal, includes four differential transconductance amplifiers and two loads. Transistors in the differential pair of each differential transconductance amplifier are operated in the subthreshold region. Four linear-combination signals are individually fed into one input terminal of the four differential transconductance amplifiers. A linear-combination circuit configuration is also disclosed and can be used to generate the required linear-combination signals.

10 Claims, 5 Drawing Sheets

FOUR-QUADRANT THREE-INPUT MULTIPLIER

BACKGROUND OF THE INVENTION

1. Field of the Invention

The present invention is in general related to an integrated circuit. More specifically, the present invention is related to a four-quadrant three-input multiplier that can receive three distinct signals and multiply them together. Such a scheme can be utilized under low-voltage conditions. Four-quadrant three-input multipliers can be used as modulators, demodulators, triplers, and to synthesize nonlinear functions.

2. Description of the Invention

Multipliers are essential components that serve as building blocks for calculating the product of two or more different signals. In bipolar transistor technology, Gilbert cells are usually used to build a four-quadrant multiplier. But in MOS transistor technology, four approaches have emerged. The first approach, similar to the case of bipolar technology, is to use Gilbert cells to build a four-quadrant multiplier. The second approach is to use the properties of MOS transistors operated in the saturation region to design multipliers. The saturation region is also called an active region where the drain current value is proportional to the square of the gate-drain voltage value. The third approach is to use the properties of MOS transistors operated in the linear region to design multipliers. The linear region is also called the triode region where the drain current value is linearly proportional to the gate-source voltage while the drain-source voltage is a constant. The fourth or last approach is to use the properties of MOS transistors operated in the subthreshold region to design multipliers.

Conventionally, two Gilbert cells or other type of multipliers that are serially or cascadedly connected are usually utilized to constitute a three-input multiplier. However, such a configuration can not concurrently receive all three input signals. The output signal from the previous Gilbert cell, which receives the first two input signals, is temporally incompatible with the last input signal in the subsequent Gilbert cell, due to time delay in the previous Gilbert cell. In addition, a cascaded-type configuration has a complex structure.

Increasingly smaller size and low power operation are the trends of integrated circuits in the future. Thus, it is essential to make integrated circuits operate with low voltage supplies and low power consumption.

SUMMARY OF THE INVENTION

Based on such circumstances, the first object of the present invention is to provide a four-quadrant three-input multiplier, which can concurrently receive three different input signals and multiply them together, then yield an analog signal proportional to the product of the three input signals.

The second object of the present invention is to provide a four-quadrant three-input multiplier, which has a simple structure and can be easily implemented.

The third object of the present invention is to provide a four-quadrant three-input multiplier, which can be operated under low-voltage conditions and efficiently reduce power losses.

In view of the above-mentioned objects, the present invention is intended to provide a four-quadrant three-input multiplier for calculating the product of a first input signal, a second input signal, and a third input signal, then outputting results to a differential output terminal. The four-quadrant three-input multiplier comprises a first differential transconductance amplifier, in which a first input terminal receives a first linear-combination signal resulting from the first input signal, added by the second input signal, and added by the third input signal, and a first and a second output terminals are coupled to a negative and a positive ports of the differential output terminal of the three-input multiplier, respectively; a second differential transconductance amplifier, in which a first input terminal receives a second linear-combination signal resulting from the first input signal, added by the second input signal, and subtracted by the third input signal, and a first and a second output terminals are coupled to the positive and negative ports of the differential output terminal of the three-input multiplier, respectively; a third differential transconductance amplifier, in which a first input terminal receives a third linear-combination signal resulting from the first input signal, subtracted by the second input signal, and added by the third input signal, and a first and a second output terminals are coupled to the positive and negative ports of the differential output terminal of the three-input multiplier, respectively; a fourth differential transconductance amplifier, in which a first input terminal receives a fourth linear-combination signal resulting from the first input signal, subtracted by the second input signal, and subtracted by the third input signal, and a first and a second output terminals are coupled to the negative and positive ports of the differential output terminal of the three-input multiplier, respectively; a first load coupled between a high-voltage source and the negative port of the differential output terminal; and a second load coupled between the high-voltage source and the positive port of the differential output terminal. The resistance value of the second load is equal to that of the first load.

BRIEF DESCRIPTION OF THE DRAWINGS

The detailed description of an embodiment of the present invention will be made with reference to the accompanying drawings, wherein.

DETAILED DESCRIPTION OF PREFERRED EMBODIMENTS

In this embodiment, we use MOS transistors to constitute the four-quadrant three-input multiplier of the present invention. However, this implies no limitation on the scope of the present invention. A bipolar transistor circuit can be easily applied in the same manner.

The operation mode of a common MOS transistor will be described. When the gate-source voltage $V_{GS}$ exceeds the threshold voltage $V_{TH}$ in a MOS transistor, the MOS transistor is termed to be operated in the saturation region. If the gate-source voltage $V_{GS}$ does not exceed but approaches to the threshold voltage $V_{TH}$, the MOS transistor is operated in the subthreshold region. MOS transistors operated in the subthreshold region exhibit an exponential relationship between the drain current $I_D$ and the gate-source voltage $V_{GS}$, and the drain current can be expressed as $$I_D = I_{D0}\frac{W}{L}\exp\left(\frac{V_{GS}-V_{TH}}{nV_T}\right) \quad (1)$$

where $I_{DO}$ and W/L are the characteristic current and the aspect ratio of the MOS transistor operated in the subthreshold region. The variable n is the slope parameter of the MOS transistor operated in the subthreshold region, usually between 1 and 2. VT is the thermal voltage, usually 25 mV at room temperature. In this embodiment, we use MOS transistors operated in the subthreshold region to constitute the four-quadrant three-input multiplier.

Figure 1:
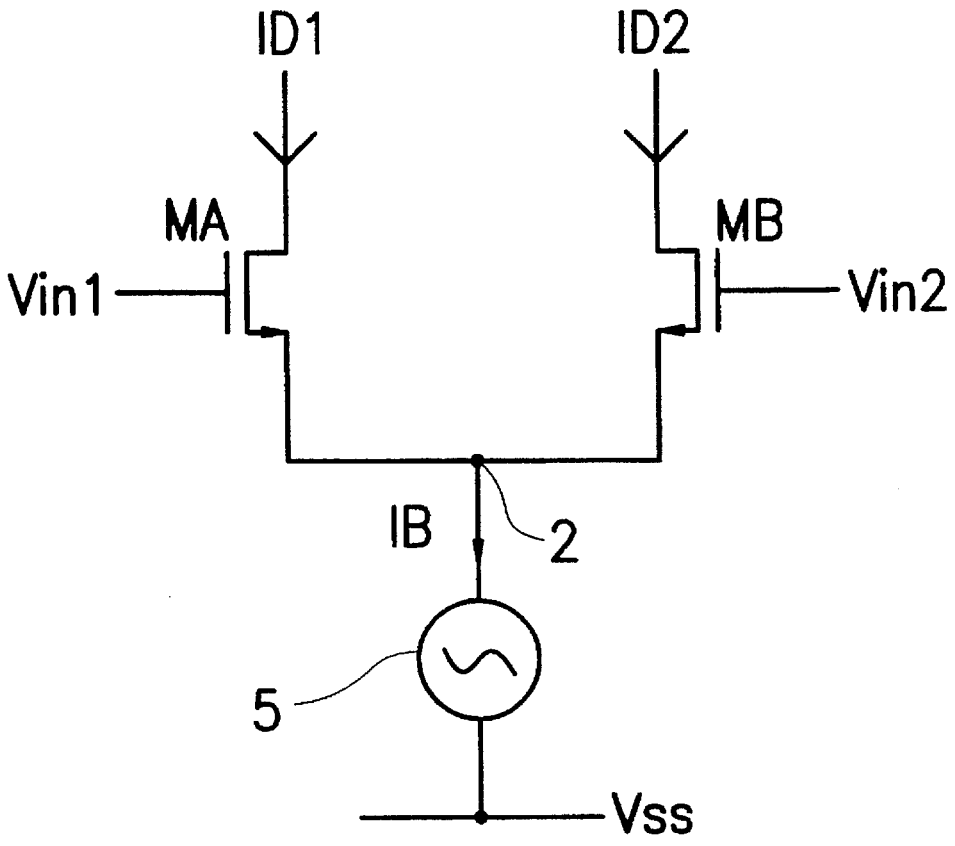
FIG. 1 is a circuit diagram of a general MOS differential transconductance amplifier.

FIG. 1 shows a circuit diagram of a common MOS differential transconductance amplifier. The NMOS transistors MA and MB constitute a differential pair to receive input signals Vin1 and Vin2. If the NMOS transistors MA and MB are forced to operate in the subthreshold region, the drain currents ID1 and ID2 flowing through the transistors MA and MB will follow the Equation (1). Therefore, based on Equation (1) and the fact that the current IB flowing through the current source 5 is equal to the drain current ID1 flowing through the transistor MA added to the drain current ID2 flowing through the transistor MB, we can deduce the following relation:

$$ID1 - ID2 = IB\tanh\left(\frac{Vin1 - Vin2}{2nV_T}\right) \quad (2)$$

where tanh( . . . ) is the hyperbolic tangent function.

Figure 2:
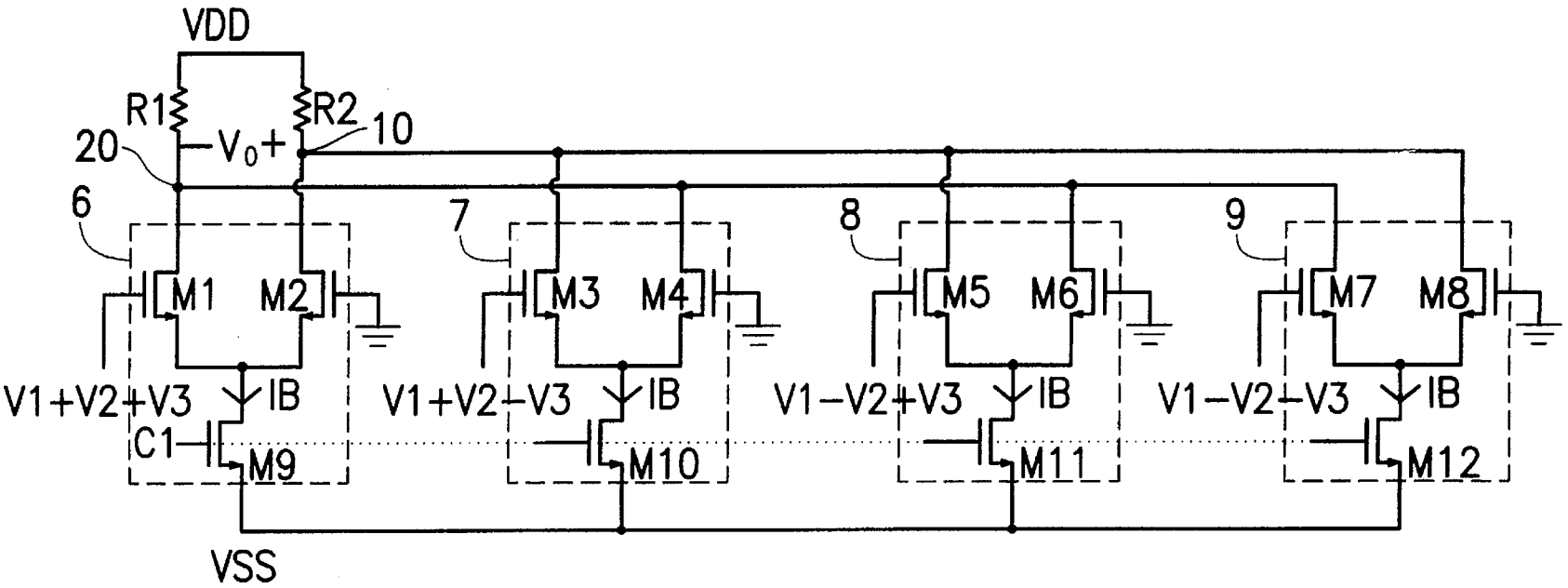
FIG. 2 is a circuit diagram of the four-quadrant three-input multiplier according to the present invention.

FIG. 2 is a circuit diagram of the four-quadrant three-input multiplier according to the present invention, which is constructed by differential pairs as shown in FIG. 1. MOS transistors M1, M2, and M9 constitute a first differential transconductance amplifier 6; MOS transistors M3, M4, and M10 constitute a second differential transconductance amplifier 7; MOS transistors M5, M6 and M11 constitute a third differential transconductance amplifier 8; and MOS transistors M7, M8, and M12 constitute a fourth differential transconductance amplifier 9. In this embodiment, MOS transistors M9, M10, M11, and M12 serve as current sources, like the current source 5 shown in FIG. 1, which provide current to the corresponding differential pairs and all are controlled by the signal C1. The first input signal V1, the second input signal V2, the third input signal V3 are formed as linear-combination signals V1+V2+V3, V1+V2−V3, V1−V2+V3, V1−V2−V3 that are fed into the gates of the transistors M1, M3, M5, M7, respectively, by linear-combination circuits, which are described later. The gates of all of the transistors M2, M4, M6, M8 are grounded. Furthermore, drains of the transistor M1, M4, M6, M7 are all coupled to the negative port 20 of the differential output terminal, and drains of the transistors M2, M3, M5, M8 are all coupled to the positive port 10 of the differential output terminal. Therefore, the output current $I_0$ can be expressed as $$\begin{aligned} I_0 &= I_1 + I_4 + I_6 + I_7 - I_2 - I_3 - I_5 - I_8 \\ &= IB\tanh\left(\frac{V1+V2+V3}{2nV_T}\right) - \\ &\quad IB\tanh\left(\frac{V1+V2-V3}{2nV_T}\right) - \\ &\quad IB\tanh\left(\frac{V1-V2+V3}{2nV_T}\right) + \\ &\quad IB\tanh\left(\frac{V1-V2-V3}{2nV_T}\right) \end{aligned} \quad (3)$$

where $I_i$ (i=1 to 8) is the drain current of a transistor Mi.

According to the Taylor's series of the hyperbolic tangent function tanh (x), when |x|<1, the value of the hyperbolic tangent function tanh(x) will approach $$x - \frac{x^3}{3}.$$

Based on the Equation (3) and the above-mentioned approximation, we can deduce that the differential output terminal voltage $V_0$ is $$V_0 = RI_0 = -R \times IB \times \frac{V1 \times V2 \times V3}{(nV_T)^3} \quad (4)$$

where R represents the resistance value of the resistors R1 and R2. The resistors R1 and R2 can be implemented by resistors or linearized MOS transistors. Therefore, the differential output terminal voltage $V_0$ is proportional to the product of the first input signal V1, the second input signal V2, and the third input signal V3.

Figure 3:
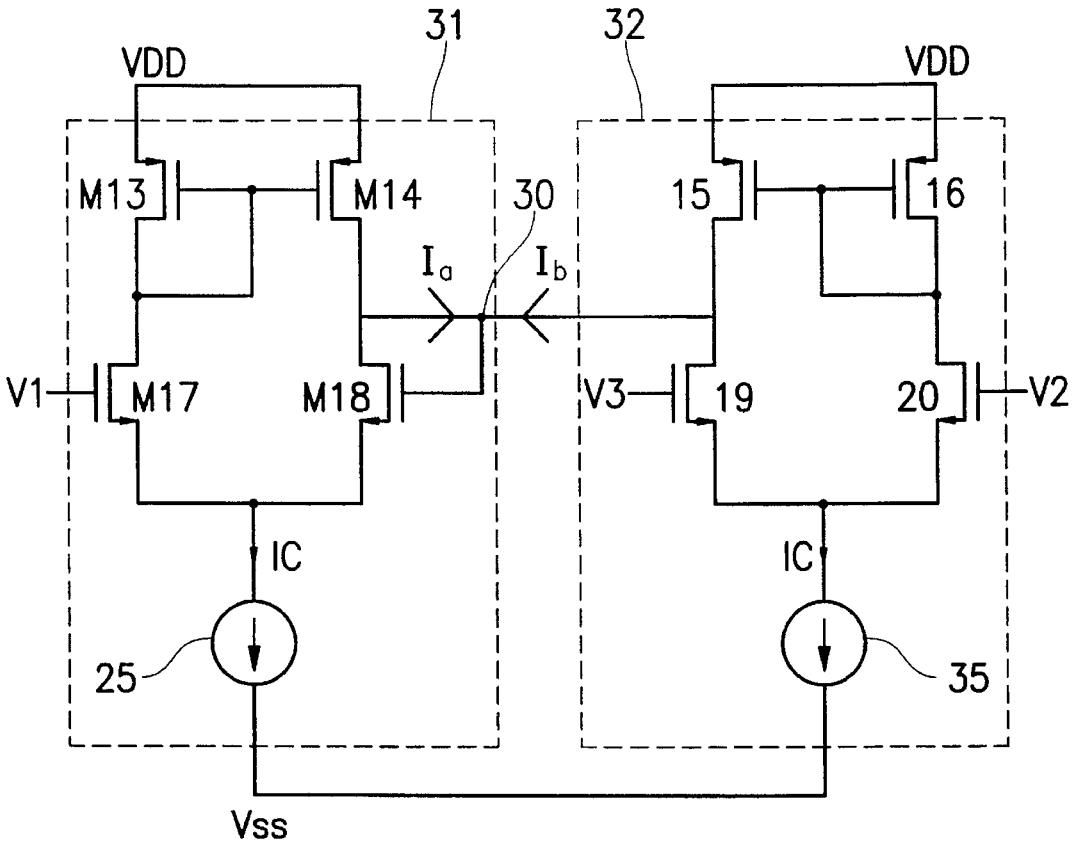
FIG. 3 is a circuit diagram of the linear-combination circuit that generates the linear-combination signal V1+V2−V3 used in FIG. 2.

FIG. 3 shows a circuit diagram of a linear-combination circuit employed in this embodiment. The structure shown in FIG. 3 is used to generate the linear-combination signal V1+V2−V3, however, such a scheme also can be employed to generate the signals V1+V2+V3, V1−V2+V3, and V1−V2−V3. The linear-combination circuit shown in FIG. 3 contains a left differential amplifier 31, which consists of PMOS transistors M13 and M14 and NMOS transistors M17 and M18, and a right differential amplifier 32, which consists of PMOS transistors M15 and M16 and NMOS transistors M19 and M20. The required signal V1+V2−V3 can be acquired by means of the state of balance between the left and right differential amplifiers. At node 30, neglecting the minor gate current of the transistor M18, the current Ia and the current Ib are equal. When the transistors M17, M18, M19, and M20 are operated in the subthreshold region, the currents Ia and Ib, based on the Equation (2), can be expressed as $$Ia = IC\tanh\left(\frac{V1 - Vx}{2nV_T}\right) \quad (5)$$

$$Ib = IC\tanh\left(\frac{V2 - V3}{2nV_T}\right) \quad (6)$$

where IC is the current value of the current source 25, which is the same as that of the current source 35, and Vx is the output voltage of the linear-combination circuit at node 30. Therefore, under the state of balance, which is Ia=−Ib, the output voltage Vx can expressed as $$Vx = V1 + V2 - V3 \quad (7)$$

Figure 4:
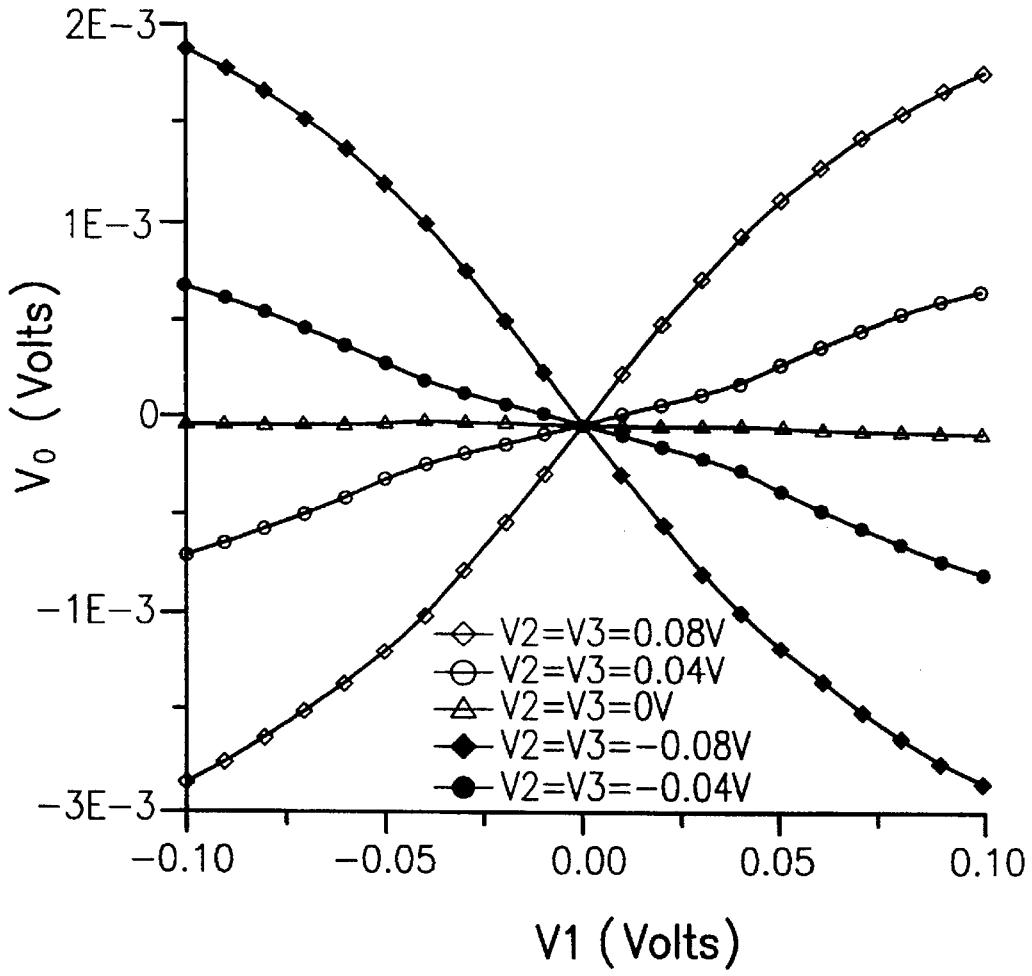
FIG. 4 is a chart which shows the relationship of the first input signal V1 to the output signal $V_0$, under the condition of various second V2 and third V3 input signals.
Figure 5:
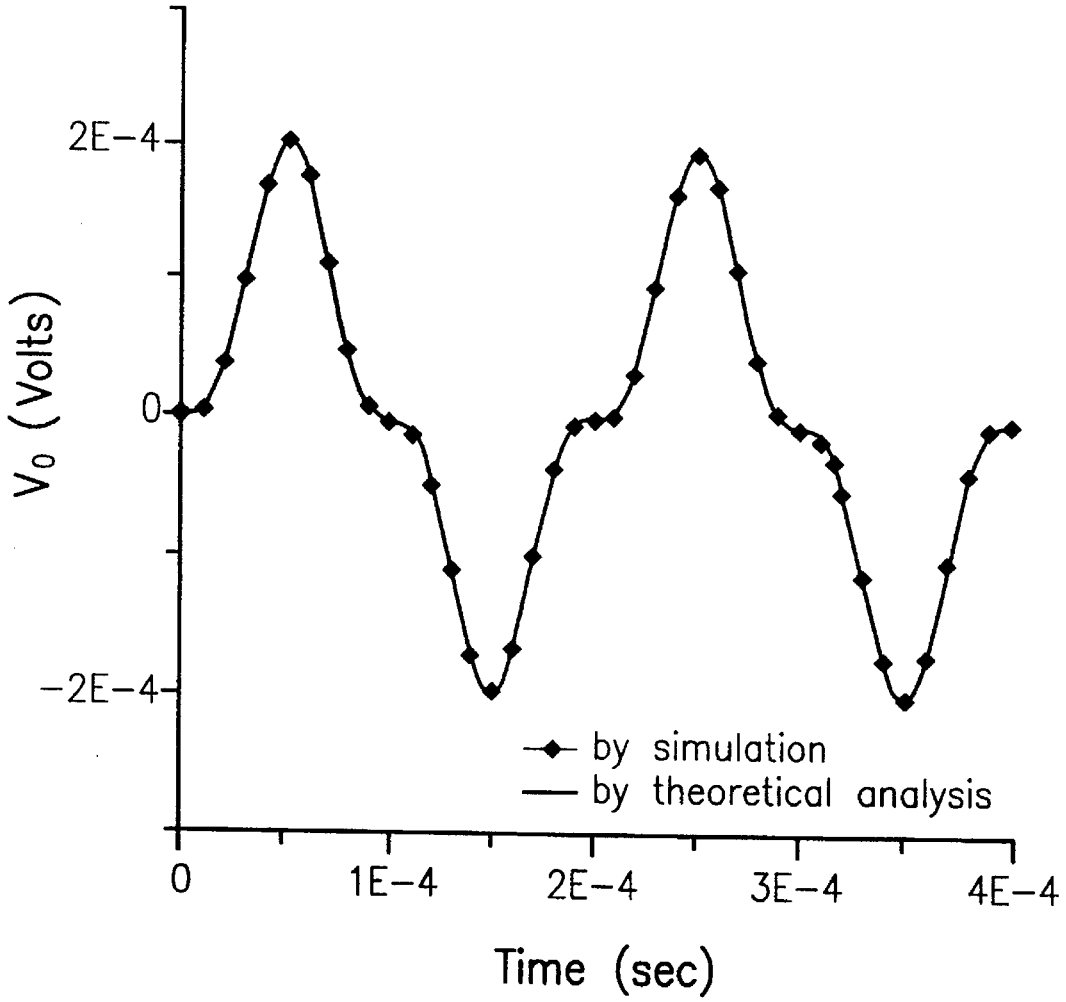
FIG. 5 is an output signal diagram of the four-quadrant three-input multiplier according to the present invention, generated by theoretical analysis and simulation.

FIG. 4 iS a chart which shows the relationship of the first input signal (V1) to the output signal ($V_0$), under the condition of various second (V2) and third (V3) input signals after simulating by the SPICE program with the parameters of 2 μm CMOS process. The various conditions are V2=V3=0.08 V, V2=V3=0.04 V, V2=V3=0 V, V2=V3=−0.04 V, and V2=V3=−0.08 V. With a ±1.5 V power source, the linear operation region of the three-input multiplier is about ±40 mV and the −3 dB bandwidth is about 100 kHz. FIG. 5 is an output signal diagram of the four-quadrant three-input multiplier according to the present invention, generated by theoretical analysis and simulation. In FIG. 5, the simulation results are very close to the theoretical data and meet our requirements.

The advantages of the present invention are:

1. The four-quadrant three-input multiplier according to the present invention can simultaneously receive three distinct input signals. Such a structure can be employed in a high-speed integrated circuit with none of the timing problems as in the prior art.
2. The three-input multiplier can be implemented by a CMOS circuit, in which PMOS transistors serve as the loads and NMOS transistors serve as the differential pairs. Therefore, the present invention can be used in low-power applications.

The foregoing description of preferred embodiments the present invention has been provided for the purposes of illustration and description. It is not intended to be exhaustive or to limit the invention to the precise forms disclosed. Many modifications and variations will be apparent to practitioners skilled in this art. For example, the differential transconductance amplifiers can employ bipolar transistor differential pairs instead of MOS transistor differential pairs. The embodiments were chosen and described to best explain the principles of the invention and its practical application, thereby enabling others skilled in the act to understand the invention for various embodiments and with various modifications as are suited to the particular use contemplated. It is intended that the scope of the invention be defined by the following claims and their equivalents.

What is claimed is:

1. A four-quadrant three-input multiplier for determining the product of a first input signal, a second input signal, and a third input signal, then outputting results to a differential output terminal, which is coupled between a high-voltage source and a low-voltage source, said four-quadrant three-input multiplier comprising:

a first differential transconductance amplifier, wherein a first input terminal of said first differential transconductance amplifier receives a first linear-combination signal which is substantially equal to said first input signal, plus said second input signal, plus said third input signal, a second input terminal of said first differential transconductance amplifier is grounded, and a first output terminal and a second output terminal of said first differential transconductance amplifier are coupled to a negative port and a positive port of said differential output terminal of said three-input multiplier, respectively;

a second differential transconductance amplifier, wherein a first input terminal of said second differential transconductance amplifier receives a second linear-combination signal which is substantially equal to said first input signal, plus said second input signal, minus said third input signal, a second input terminal of said second differential transconductance amplifier is grounded, and a first output terminal and a second output terminal of said second differential transconductance amplifier are coupled to said positive and negative ports of said differential output terminal of said three-input multiplier, respectively;

a third differential transconductance amplifier, wherein a first input terminal of said third differential transconductance amplifier receives a third linear-combination signal which is substantially equal to said first input signal, minus said second input signal, plus said third input signal, a second input terminal of said third differential transconductance amplifier is grounded, and a first output terminal and a second output terminal of said third differential transconductance amplifier are coupled to the positive and negative ports of said differential output terminal of said three-input multiplier, respectively;

a fourth differential transconductance amplifier, wherein a first input terminal of said fourth differential transconductance amplifier receives a fourth linear-combination signal which is substantially equal to said first input signal, minus said second input signal, minus said third input signal, a second input terminal of said fourth differential transconductance amplifier is grounded, and a first output terminal and a second output terminal of said fourth differential transconductance amplifier are coupled to the negative and positive ports of said differential output terminal of said three-input multiplier, respectively;

a first load coupled between said high-voltage source and the negative port of said differential output terminal of said three-input multiplier; and a second load coupled between said high-voltage source and the positive port of said differential output terminal of said three-input multiplier, wherein the resistance value of said second load is equal to that of said first load.

2. The four-quadrant three-input multiplier of claim 1, wherein each differential transconductance amplifier comprises:

a first MOS transistor operated in the subthreshold region, in which a gate and a drain of said first MOS transistor serve as the first input terminal and the first output terminal of said differential transconductance amplifier;

a second MOS transistor operated in the subthreshold region, in which a gate and a drain of said second MOS transistor serve as the second input terminal and the second output terminal of said differential transconductance amplifier; and a current source coupled between a connected terminal of sources of said first MOS transistor and said second MOS transistor, and said low-voltage source.

3. The four-quadrant three-input multiplier of claim 2, wherein a drain current ID1 of said first MOS transistor and a drain current ID2 of said second MOS transistor have the relationship $$ID1 - ID2 = IB \tanh\left(\frac{Vin1 - Vin2}{2nV_T}\right)$$

where IB is the current flowing through said current source, Vin1 and Vin2 are voltages at the gates of said first MOS transistor and said second MOS transistor, respectively, n is the slope parameter of said first and second MOS transistors, and $V_T$ is the thermal voltage.

4. The four-quadrant three-input multiplier of claim 1, wherein said differential transconductance amplifiers comprise bipolar transistor differential pairs.

5. The four-quadrant three-input multiplier of claim 1, further comprising linear-combination circuits which generate said linear-combination signals.

6. The four-quadrant three-input multiplier of claim 5, wherein each linear-combination circuit comprises:

a left differential amplifier having a first input, a second input, and an output; and a right differential amplifier having a first input, a second input, and an output, wherein said second input and said output of said left differential amplifier and said output of said right differential amplifier are connected to output the linear-combination signal generated by said linear-combination circuit, and wherein said first input of said left differential amplifier and said first and second inputs of said right differential amplifier respectively receive said first input signal, said second input signal, and said third input signal in one of said linear combination circuits.

7. The four-quadrant three-input multiplier of claim 1, wherein said first load comprises a MOS transistor.

8. The four-quadrant three-input multiplier of claim 1, wherein said first load comprises a resistor.

9. The four-quadrant three-input multiplier of claim 1, wherein said second load comprises a MOS transistor.

10. The four-quadrant three-input multiplier of claim 1, wherein said second load comprises a resistor.

* * * * *